US009397433B2

(12) United States Patent
Kao et al.

(10) Patent No.: US 9,397,433 B2
(45) Date of Patent: Jul. 19, 2016

(54) ELECTRICAL PLUG CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/755,605

(22) Filed: Jun. 30, 2015

(65) Prior Publication Data

US 2015/0380858 A1 Dec. 31, 2015

(30) Foreign Application Priority Data

| | | |
|---|---|---|
| Jun. 30, 2014 | (TW) | 103211620 U |
| Jul. 8, 2014 | (TW) | 103123536 A |
| Dec. 4, 2014 | (TW) | 103142260 A |

(51) Int. Cl.

| | |
|---|---|
| ***H01R 13/66*** | (2006.01) |
| ***H01R 13/502*** | (2006.01) |
| ***H01R 24/60*** | (2011.01) |
| ***H01R 13/658*** | (2011.01) |
| *H01R 107/00* | (2006.01) |

(52) U.S. Cl.

CPC ..... *H01R 13/502* (2013.01); *H01R 13/658* (2013.01); *H01R 24/60* (2013.01); *H01R 2107/00* (2013.01)

(58) Field of Classification Search

CPC .. H01R 13/502; H01R 24/60; H01R 2107/00; H01R 13/658

USPC ..... 439/620.22, 676, 660, 607.01

See application file for complete search history.

(56) References Cited

U.S. PATENT DOCUMENTS 9,153,895 B2 * 10/2015 Kao ..... H01R 13/65802 607/1

* cited by examiner

*Primary Examiner* — Javaid Nasri

(74) *Attorney, Agent, or Firm* — Muncy, Geissler, Olds & Lowe, P.C.

(57) ABSTRACT

An electrical plug connector includes an insulated housing, terminals and a fixing base. The insulated housing includes a base member and terminal slots defined through the base member along a longitudinal direction. The terminals are at the insulated housing, and each of the terminals includes a body portion and a tail portion. The connecting segments are at the terminal slots respectively, and the tail portions are respectively extending from the connecting portions and protruded out of a rear side of the base member. The fixing base is at the rear side of the base member, and includes a partition board and barriers. The partition board defines two lateral surfaces corresponding to each other. The barriers are respectively extending from the lateral surfaces, and through grooves are defined between the barriers. Each of the barriers is covered to two sides of the corresponding soldering portion.

16 Claims, 13 Drawing Sheets

| | | | | | | | | | | | | |
|---|---|---|---|---|---|---|---|---|---|---|---|---|
| GND | RX2+ | RX2− | VBUS | RFU | D− | D+ | CC1 | VBUS | TX1− | TX1+ | GND | 21 |
| GND | TX2+ | TX2− | VBUS | CC2 | D+ | D− | RFU | VBUS | RX1− | RX1+ | GND | 22 |

Fig. 1C

ELECTRICAL PLUG CONNECTOR

CROSS-REFERENCES TO RELATED APPLICATIONS

This non-provisional application claims priority under 35 U.S.C. §119(a) on Patent Application No. 103211620, 103123536, and 103142260, filed in Taiwan, R.O.C. on 2014 Jun. 30, 2014 Jul. 8, and 2014 Dec. 4 respectively, the entire contents of which are hereby incorporated by reference.

FIELD OF THE INVENTION

The instant disclosure relates to an electrical connector, and more particularly to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is not sufficient. As a consequence, faster serial bus interfaces, USB 3.0, are developed, which may provide a higher transmission rate so as to satisfy the need of a variety devices.

An existing USB electrical plug connector includes an insulated housing and a plurality of transmission terminals. When the transmission terminals are passing through the insulated housing, the soldering pins at rear sides of the transmission terminals are exposed. That is, the soldering pins are exposed from the rear side of the insulated housing, and after the rear side of the insulated housing is assembled with a circuit board, the soldering pins are soldered on the circuit board and soldered to a transmission wire.

However, when the soldering pins are soldered on the circuit board or soldered to the transmission wire, the soldering pins are prone to slant easily due to the rear side of the insulated housing is devoid of a structure to limit the soldering pins efficiently. Therefore, the soldering process becomes difficult to carry out.

SUMMARY OF THE INVENTION

Therefore, how to solve the problem of the conventional structure is a question that related manufacturers must think about.

In view of the above problem, an embodiment of the instant disclosure provides an electrical plug connector comprising a metallic shell, an insulated housing, a plurality of upper-row plug terminals, a plurality of lower-row plug terminals, and a fixing base. The metallic shell defines a receiving cavity therein. The insulated housing is received in the receiving cavity. The insulated housing comprises a base member, an upper portion, a lower portion, a mating room, a plurality of upper-row terminal slots, and a plurality of lower-row terminal slots. The upper portion and the lower portion are extending from one side of the base member. The mating room is defined between the upper portion and the lower portion, and the upper-row terminal slots and the lower-row terminal slots are defined through the base member, the upper portion, and the lower portion along a longitudinal direction. The upper portion has an upper mating face, the lower portion has a lower mating face, and the upper mating face corresponds to the lower mating face. The upper-row plug terminals are held in the upper portion and comprise a plurality of signal terminals, at least one power terminal, and at least one ground terminal. Each of the upper-row plug terminals is held in the upper portion of the insulated housing and disposed at the upper mating face of the upper portion. Each of the upper-row plug terminals comprises a tail portion protruded from a rear side of the base member. The lower-row plug terminals are held in the lower portion and comprise a plurality of signal terminals, at least one power terminal, and at least one ground terminal. Each of the lower-row plug terminals is held in the lower portion of the insulated housing and disposed at the lower mating face of the lower portion. Each of the lower-row plug terminals comprises a tail portion protruded from the rear side of the base member. The fixing base is extending from the rear side of the base member, and the fixing base comprises a partition board and a plurality of barriers. The partition board defines two lateral surfaces corresponding to each other. The barriers are respectively extending from the lateral surfaces. A plurality of through grooves is defined between the barriers of each of the lateral surfaces. The through grooves correspond to the upper-row terminal slots and the lower-row terminal slots, and the through grooves communicate with the upper-row terminal slots and the lower-row terminal slots. The tail portions of the upper-row plug terminals and that of are respectively in the through grooves. The barriers shield two sides of the tail portions of the upper-row plug terminals and that of the lower-row plug terminals In conclusion, in the instant disclosure, the two sides of each of the tail portions of the upper-row plug terminals and that of the lower-row plug terminals are limited by the barriers of the fixing base, thus, the tail portions can be stably positioned in the through grooves, respectively. Therefore, of the tail portions can be prevented from being slanted, such that the soldering process can be carried out smoothly. In addition, the width of the fixing base is less than the width of the recess. After the circuit board is assembled to the fixing base, the two outer lateral sides of the fixing base are mated with the two inner lateral surfaces of the recess. Therefore, when the tail portions are soldered on the circuit board, the tail portions and the circuit board enclose the fixing base. Moreover, the distance between the circuit board and the fixing base can be reduced, such that when over-molding is performed over the circuit board, the glue applied over the circuit board can be prevented from flowing into the gap between the circuit board and the fixing base. Furthermore, the metallic shell encloses the tail portions to protect of the tail portions and the circuit board. Hence, during the gluing process, the metallic shell protects the electrical components soldered on the circuit board from being damaged. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the disclosure.

BRIEF DESCRIPTION OF THE DRAWINGS

The disclosure will become more fully understood from the detailed description given herein below for illustration only, and thus are not limitative of the disclosure, and wherein:

FIG. 1C is a schematic configuration diagram of the plug terminals of the electrical plug connector shown in FIG. 1B;

DETAILED DESCRIPTION

Figure 1:
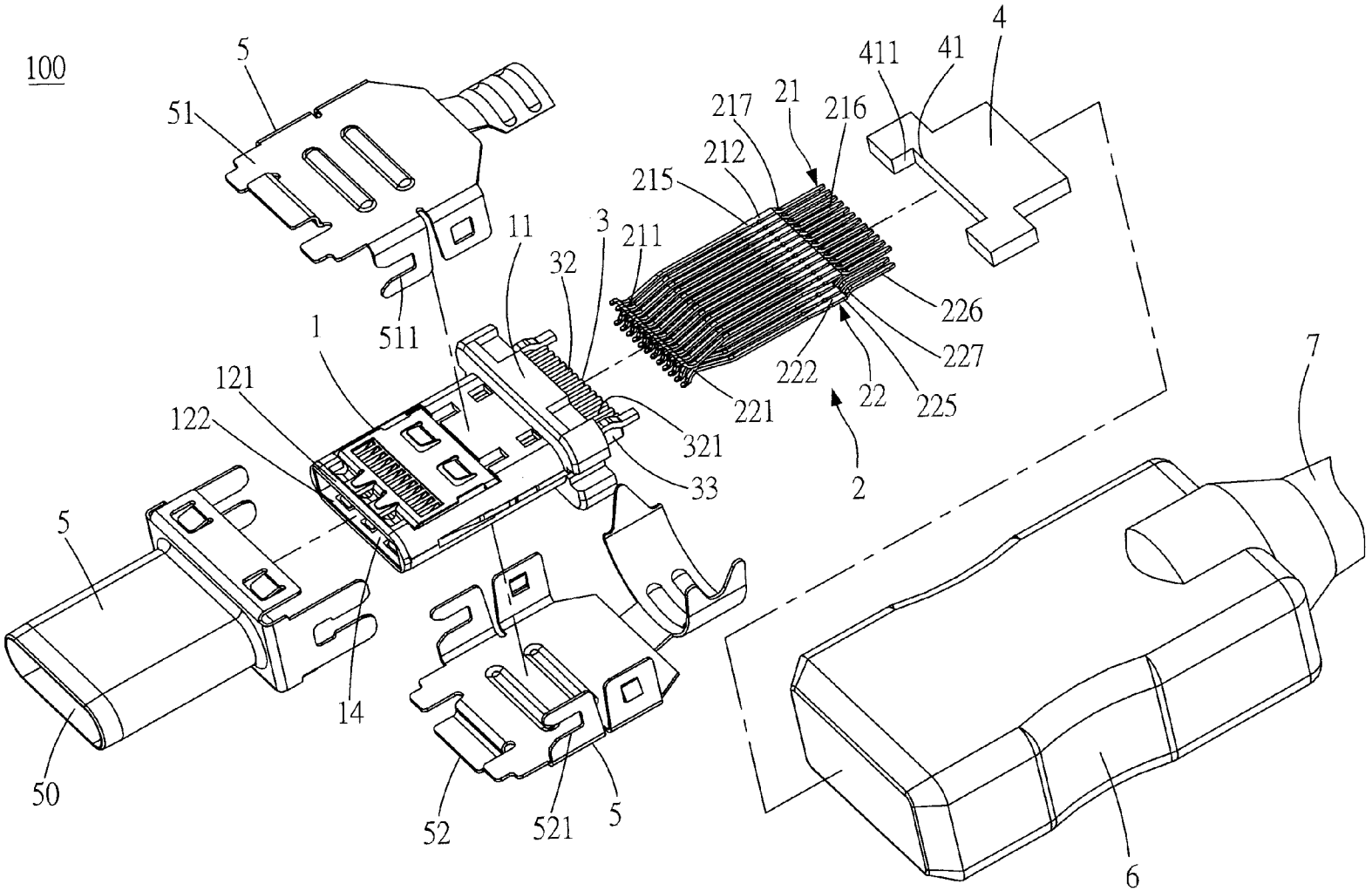
FIG. 1 is an exploded view of an electrical plug connector according to the instant disclosure.
Figure 2:
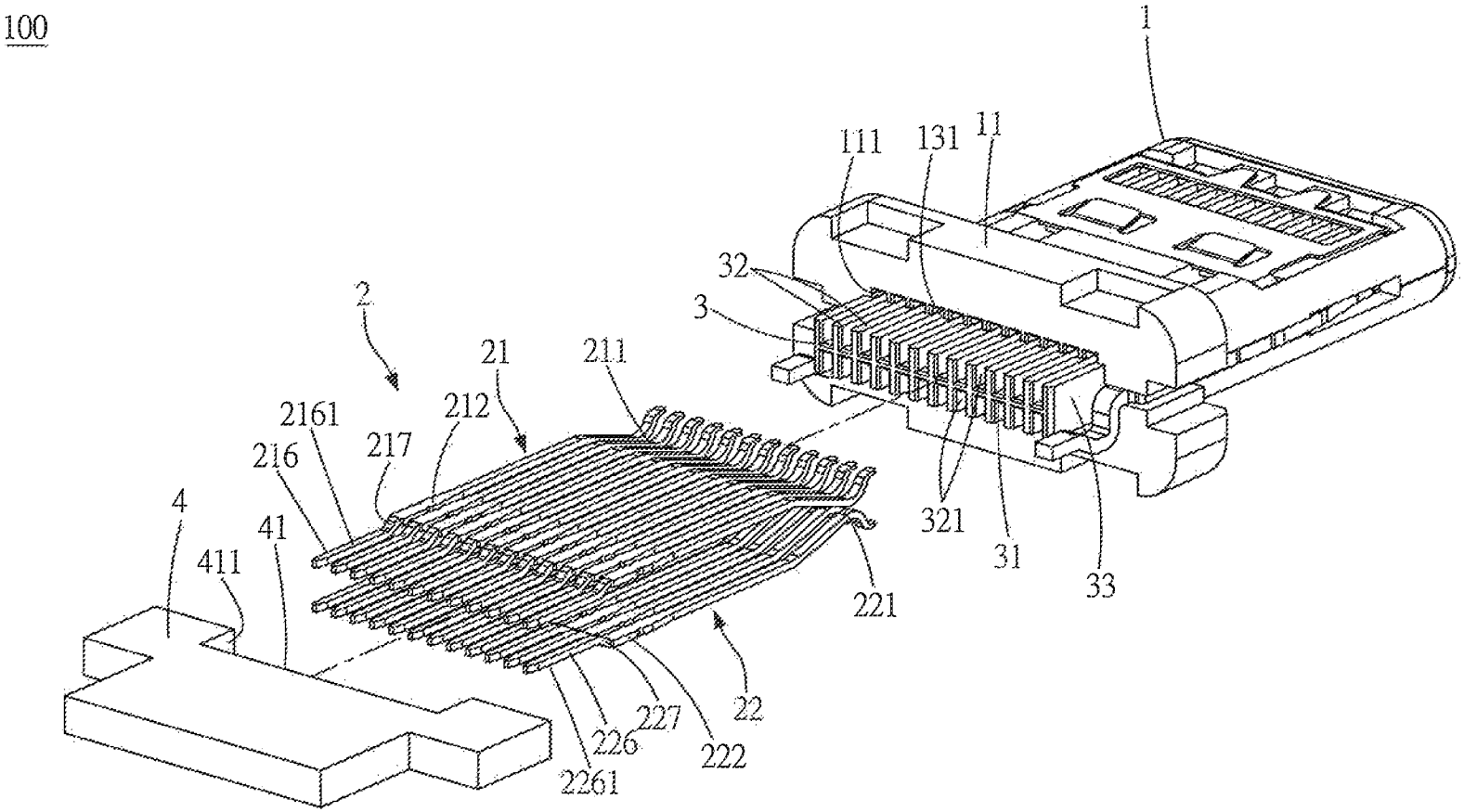
FIG. 2 is a partial exploded view (1) of the electrical plug connector according to the instant disclosure.
Figure 3A:
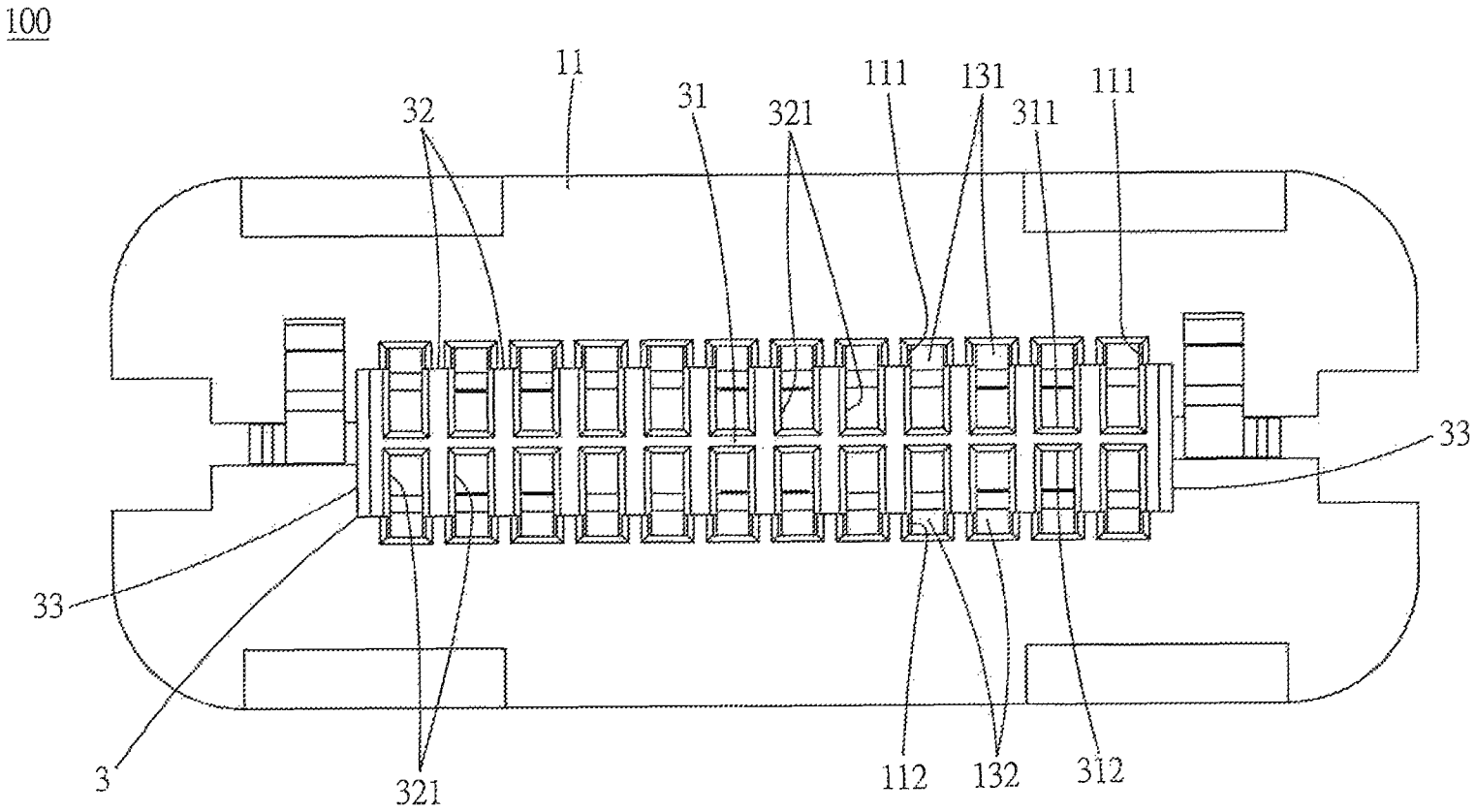
FIG. 3A is a rear lateral view of the insulated housing of the electrical plug connector according to the instant disclosure.
Figure 3B:
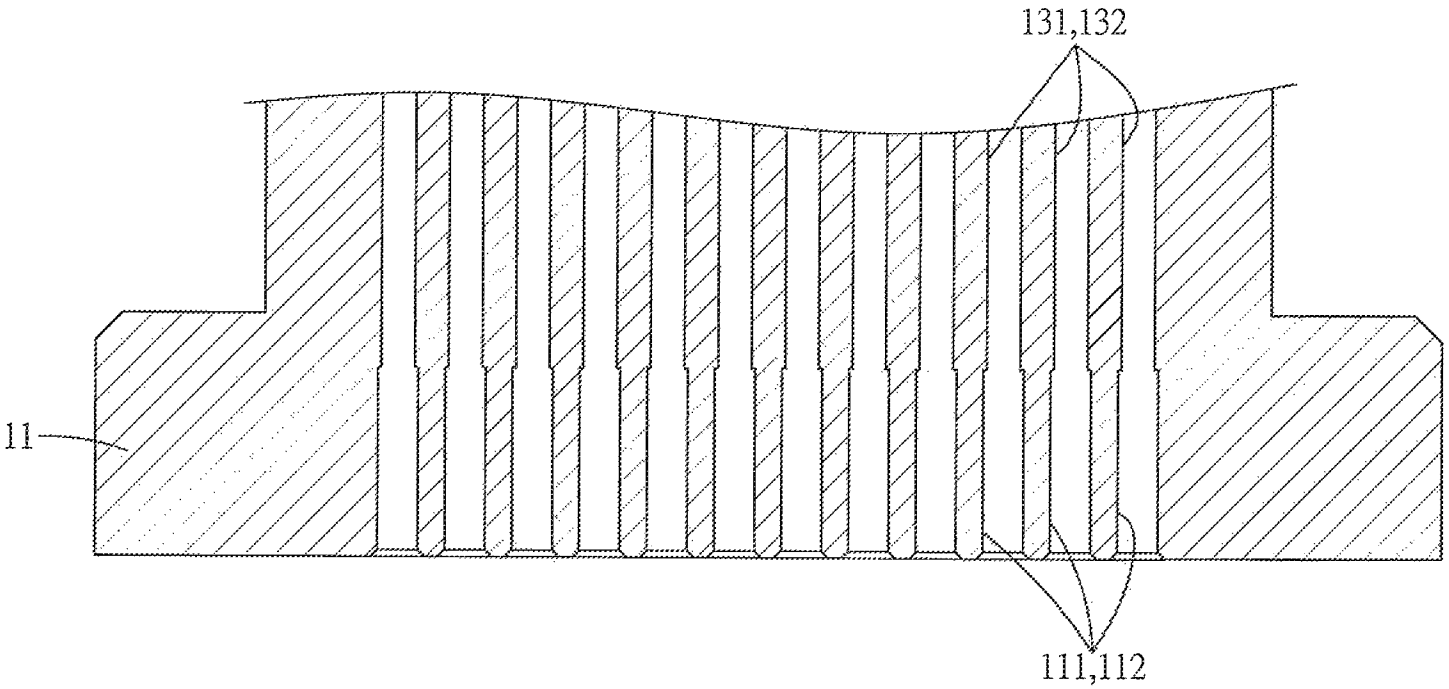
FIG. 3B is a top sectional view of the insulated housing of the electrical plug connector according to the instant disclosure.
Figure 4:
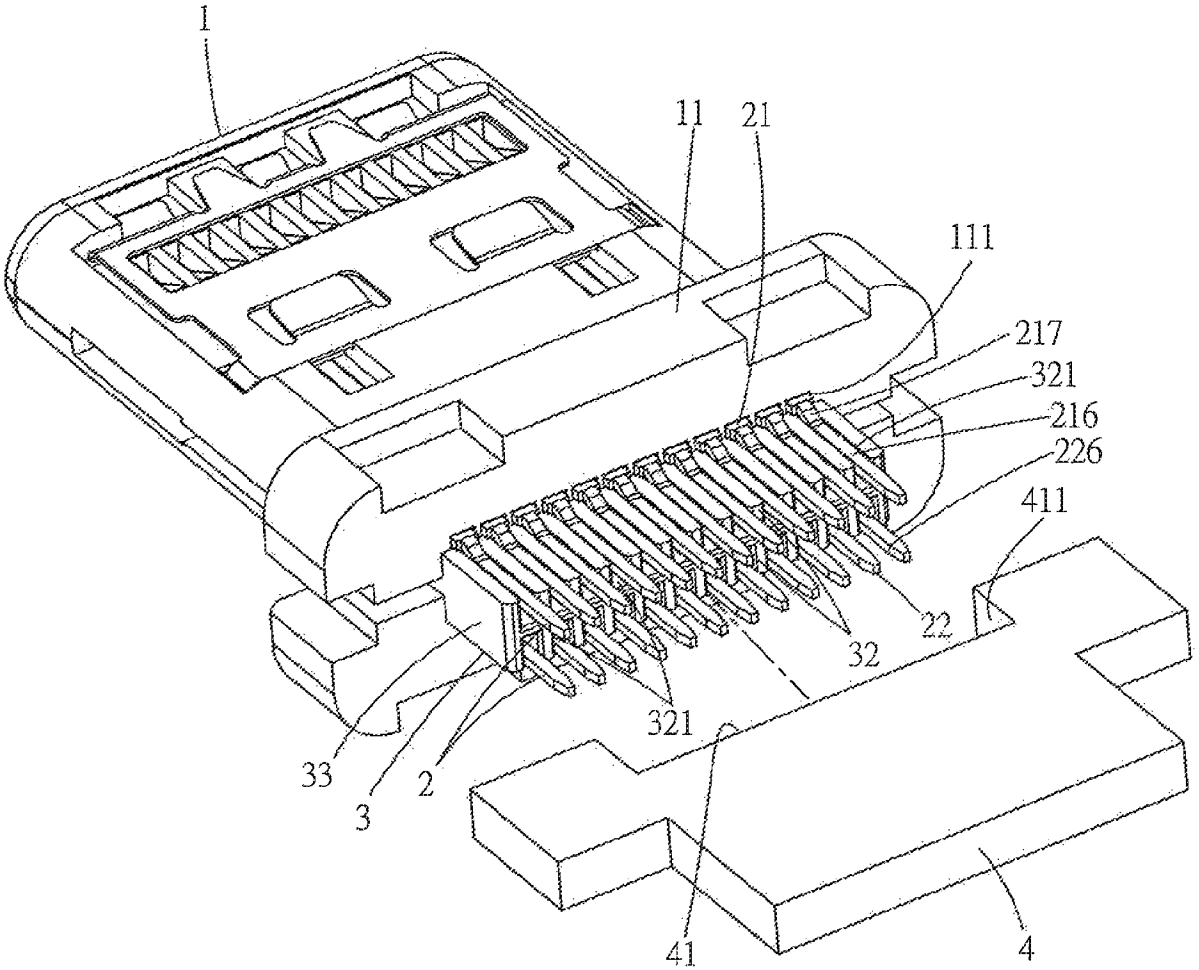
FIG. 4 is a partial exploded view (2) the electrical plug connector according to the instant disclosure.

FIG. 1 is an exploded view of an electrical plug connector according to the instant disclosure, FIG. 2 is a partial exploded view (1) of the electrical plug connector according to the instant disclosure, FIG. 3A is a rear lateral view of an insulated housing of the electrical plug connector according to the instant disclosure, FIG. 3B is a top sectional view of the insulated housing according to the instant disclosure, and FIG. 4 is a partial exploded view (2) of the electrical plug connector according to the instant disclosure. FIG. 1, FIG. 2, FIG. 3A, FIG. 3B, and FIG. 4 illustrate an exemplary embodiment of an electrical plug connector 100 according to the instant disclosure. In this embodiment, the electrical plug connector 100 provides a USB Type-C connection interface. The electrical plug connector 100 comprises an insulated housing 1, a plurality of plug terminals 2 and a fixing base 3.

Referring to FIG. 2, the insulated housing 1 comprises a base member 11, an upper portion 121, a lower portion 122, a mating room 14, a plurality of upper-row terminal slots 131, and a plurality of lower-row terminal slots 132. The base member 11, the upper portion 121, and the lower portion 122 are formed an unitary member by injection molding technique for production of insulated housing 1. The base member 11 also could be formed another unitary member by injection molding techniques and assembled with the upper portion 121 and the lower portion 122 for production of the insulated housing 1. Injection molding techniques are applied to form the upper portion 121, the lower portion 122, and the mating room 14. Moreover, the mating room 14 is defined between the upper portion 121 and the lower portion 122. The upper-row terminal slots 131 are defined through the base member 11 and the upper portion 121 along a longitudinal direction. The lower-row terminal slots 132 are defined through the base member 11 and the lower portion 122 along a longitudinal direction. That is, the upper-row terminal slots 131 and the lower-row terminal slots 132 are defined through the base member 11 along the longitudinal direction of the base member 11. The upper-row terminal slots 131 are defined on the upper part of the base member 11, and the lower-row terminal slots 132 are defined on the lower part of the base member 11. Here, the upper portion 121 and the lower portion 122 are extending from one side of the base member 11. The upper-row terminal slots 131 and the lower-row terminal slots 132 are formed on the base member 11, the upper portion 121, and the lower portion 122. The upper-row terminal slots 131 and the lower-row terminal slots 132 communicate with the mating room 14. Moreover, the upper portion 121 has an upper mating face 1211, the lower portion 122 has a lower mating face 1221, and the upper mating face 1211 of the upper portion 121 is opposite to the lower mating face 1221 of the lower portion 122.

Figure 1A:
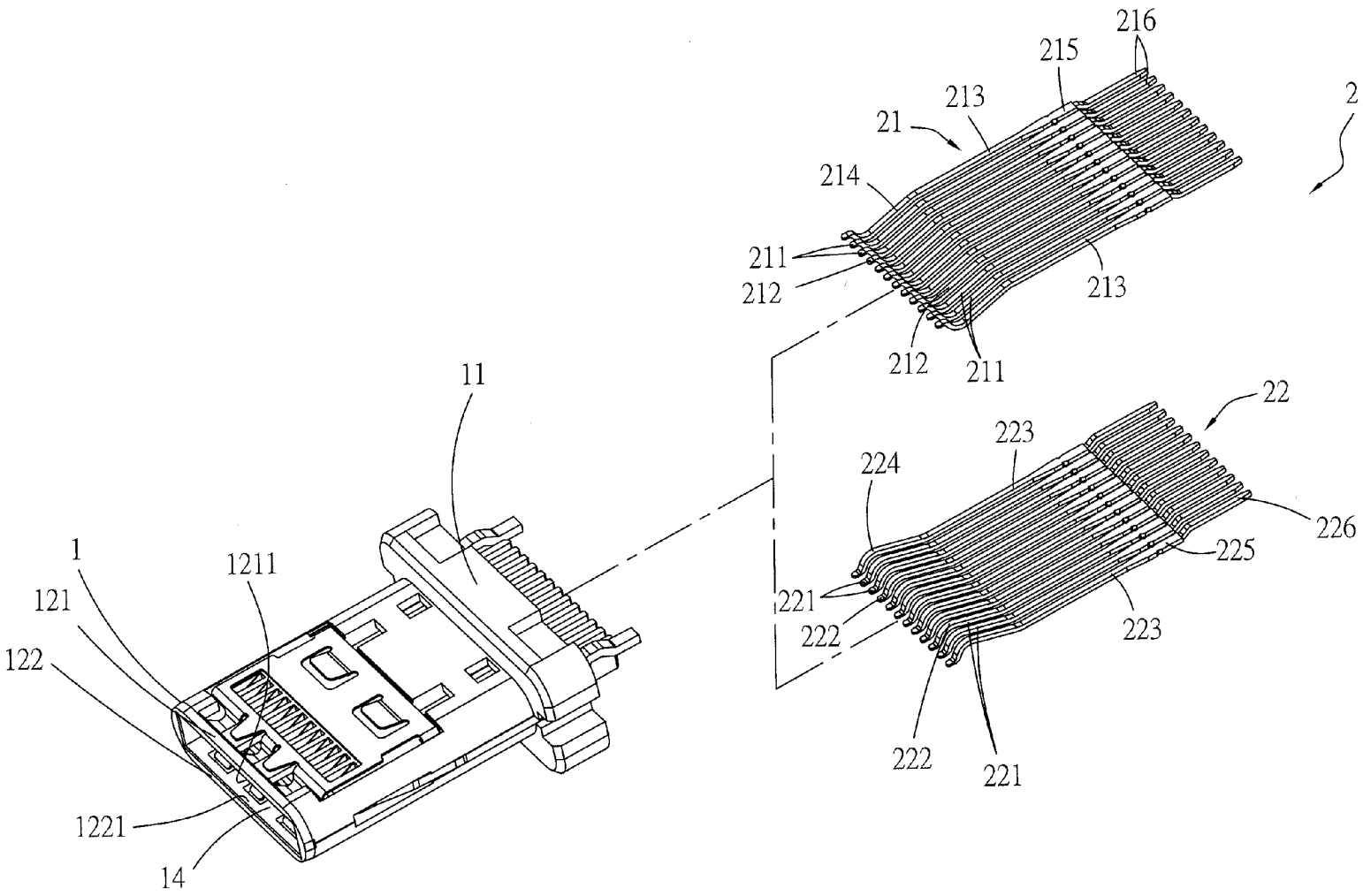
FIG. 1A is an exploded view showing an insulated housing and plug terminals of the electrical plug connector according to the instant disclosure.

Please refer to FIG. 1 and FIG. 1A. FIG. 1A is an exploded view showing the insulated housing 1 and the plug terminals 2 of the electrical plug connector 100 according to the instant disclosure. The plug terminals 2 are at the upper portion 121 and the lower portion 122. The plug terminals 2 comprise a plurality of upper-row plug terminals 21 and a plurality of lower-row plug terminals 22. The upper-row plug terminals 21 are held at the upper portion 121 and the lower-row plug terminals 22 are held at the lower portion 122.

Figure 1B:
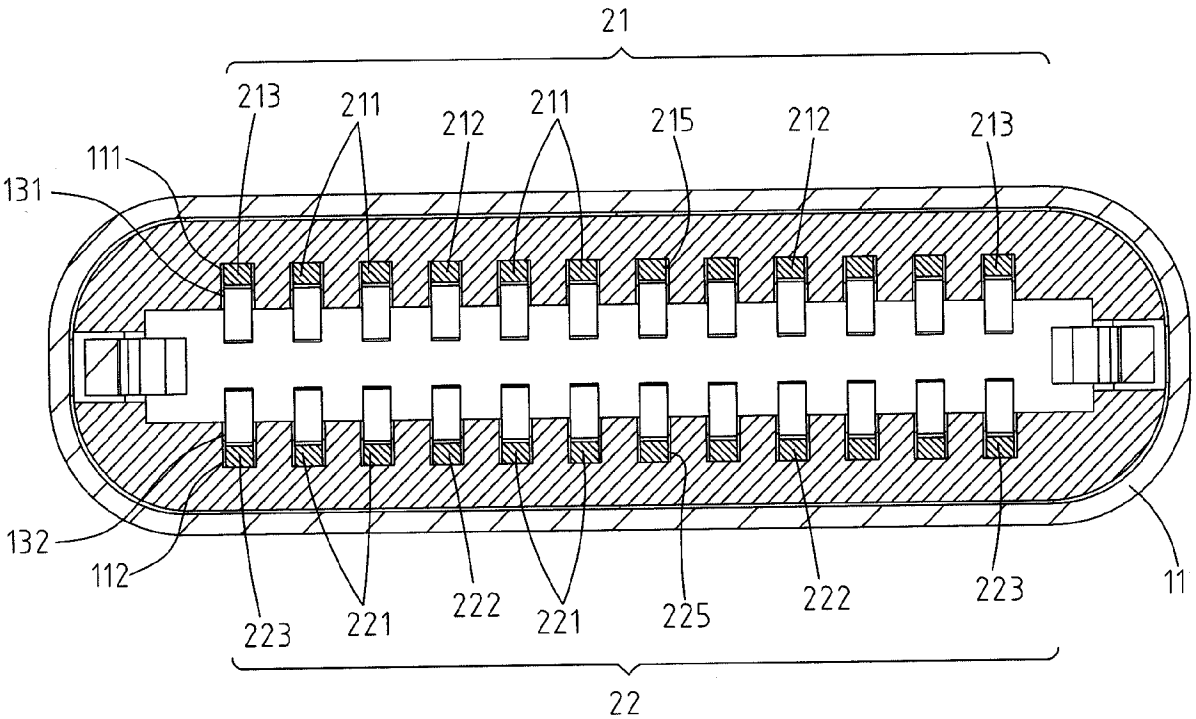
FIG. 1B is a front sectional view of the electrical plug connector according to the instant disclosure.

Please refer to FIG. 1A, FIG. 1B and FIG. 1C. FIG. 1B is a front sectional view of the electrical plug connector 100 according to the instant disclosure. FIG. 1C is a schematic configuration diagram of the plug terminals 2 of the electrical plug connector 100 shown in FIG. 1B. Here, the upper-row plug terminals 21 comprise a plurality of signal terminals 211, at least one power terminal 212, and at least one ground terminal 213. Each of the upper-row plug terminals 21 is held in the upper portion 121 of the insulated housing 1 and disposed at the upper mating face 1211 of the upper portion 121. Referring to FIG. 1C, the upper-row plug terminals 21 comprise, from right to left, a ground terminal 213 (Gnd), a first pair of differential signal terminals (TX1+−), a second pair of differential signal terminals (D+−), and a third pair of differential signal terminals (RX2+−) of the signal terminals 211, power terminals 212 (Power/VBUS) between the three pairs of differential signal terminals, a retain terminal (RFU), (the retain terminal and a configuration channel 1 (CC1) are respectively arranged between the power terminals 212 and the second pair of differential signal terminals of the signal terminals 211), and another ground terminal 213 (Gnd).

Referring to FIG. 1A, FIG. 1B and FIG. 1C, each of the upper-row plug terminals 21 comprises a body portion 215 held in the insulated housing 1, a flexible contact portion 214 extended from one end of the body portion 215 and disposed at the upper mating face 1211 of the upper portion 121, and a tail portion 216 extended from the other end of the body portion 215 and exposed out of the insulated housing 1. The flexible contact portions 214 of the signal terminals 211 are extending toward the mating room 14 and transmitting first signals (that is, USB 3.0 signals). The tail portions 216 are extending from a rear portion of the insulated housing 1. Furthermore, the tail portions 216 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C. The lower-row plug terminals 22 comprises a plurality of signal terminals 221, at least one power terminal 222, and at least one ground terminal 223. Each of the lower-row plug terminals 22 is held in the lower portion 122 of the insulated housing 1 and disposed at the lower mating face 1221 of the lower portion 122. Refer to FIG. 1C, the lower-row plug terminals 22 comprise, from left to right, a ground terminal 223 (Gnd), a first pair of differential signal terminals (TX2+−), a second pair of differential signal terminals (D+−), and a third pair of differential signal terminals (RX1+−) of the signal terminals 221, power terminals 222 (Power/VBUS) between the three pairs of differential signal terminals, a retain terminal (RFU), (the retain terminal and a configuration channel 2 (CC2) are respectively arranged between the power terminals 222 and the second pair of differential signal terminals of the signal terminals 221), and another ground terminal 223 (Gnd).

Please refer to FIG. 1A, FIG. 1B and FIG. 1C, in which each of the lower-row plug terminals 22 comprises a body portion 225 held in the insulated housing 1, a flexible contact portion 224 extended from one of two ends of the body portion 225 and disposed at the lower mating face 1221 of the lower portion 122, and a tail portion 226 extended from the other end of the body portion 225 and exposed out of the insulated housing 1. The flexible contact portions 224 of the signal terminals 221 are extending toward the mating room 14 and transmitting second signals (that is, USB 3.0 signals). The tail portions 226 are extending from the rear portion of the insulated housing 1. Furthermore, the tail portion 226 are bent horizontally to form flat legs, named SMT legs, that can be mounted or soldered on the surface of a printed circuit board (PCB) by using surface mount technology, as shown in FIG. 1A.

Please refer to FIG. 1A, FIG. 1B and FIG. 1C, in which embodiment the upper-row plug terminals 21 and the lower-row plug terminals 22 are respectively at the upper mating face 1211 of the upper portion 121 and the lower mating face 1221 of the lower portion 122. Furthermore, the upper-row plug terminals 21 and the lower-row plug terminals 22 are point-symmetrical with a central point of a receiving cavity 50 as the symmetrical center. In other words, pin-assignments of the upper-row plug terminals 21 and the lower-row plug terminals 22 have 180 degree symmetrical design with respect to the central point of the receiving cavity 50 as the symmetrical center. The dual or double orientation design enables the electrical plug connector 100 to be inserted into an electrical receptacle connector in either of two intuitive orientations, i.e., in either upside-up or upside-down directions. Here, point-symmetry means, after the upper-row plug terminals 21 (or the lower-row plug terminals 22) are rotated by 180 degrees with the symmetrical center as the rotating center, the upper-row plug terminals 21 and the lower-row plug terminals 22 are overlapped. That is, the rotated upper-row plug terminals 21 are arranged at the position of the original lower-row plug terminals 22, and the rotated lower-row plug terminals 22 are arranged at the position of the original upper-row plug terminals 21. In other words, the upper-row plug terminals 21 and the lower-row plug terminals 22 are arranged upside down, and the pin assignments of the upper-row plug terminals 21 are left-right reversal with respect to the pin assignments of the lower-row plug terminals 22. Accordingly, the electrical plug connector 100 is inserted into an electrical receptacle connector with a first orientation where the upper portion 121 of the insulated housing 1 of the electrical plug connector 100 is facing up, for transmitting first signals; conversely, the electrical plug connector 100 is inserted into the electrical receptacle connector with a second orientation where the upper portion 121 of the insulated housing 1 of the electrical plug connector 100 is facing down, for transmitting second signals. The specification for transmitting the first signals conforms to that for transmitting the second signals. Based on this, the inserting orientation of the electrical plug connector 100 is not limited.

Please refer to FIG. 1A, FIG. 1B and FIG. 1C again, in which embodiment positions of upper-row plug terminals 21 are opposite to positions of the lower-row plug terminals 22. Referring back to FIG. 2 and FIG. 3A, in which FIG. 3A is a rear lateral view of the insulated housing 1 of the electrical plug connector 100 according to the instant disclosure. In FIG. 3A, the plug terminals are not installed to the insulated housing 1. Here, the fixing base 3 is at the rear side of the base member 11. In addition, the fixing base 3 is formed by applying proper injection molding techniques to the insulated housing 1. That is, the fixing base 3 is extending from the rear side of the base member 11 of the insulated housing 1, so that the insulated housing 1 and the fixing base 3 are formed integrally. Moreover, the fixing base 3 comprises a partition board 31 and a plurality of barriers 32. The partition board 31 defines two lateral surfaces opposite to each other. That is, the partition board comprises a first lateral surface 311 and a second lateral surface 312. The first lateral surface 311 is the top surface of the partition board 31, and the second lateral surface 312 is the bottom surface of the partition board 31. The barriers 32 are respectively formed as bump structures protruded from the first lateral surface 311 or the second lateral surface 312. The barriers 32 are respectively formed at the first lateral surface 311 and the second lateral surface 312 of the partition board 31, and the barriers 32 are substantially perpendicular to the partition board 31 respectively. In other words, the barriers 32 are configured above or below the partition board 31 and are perpendicular to the partition board 31 respectively. That is, the barriers 32 are respectively extending from the lateral surfaces, and a plurality of upper-row through grooves 321 and lower-row through grooves 321 are formed between the barriers 32 of each of the lateral surfaces. That is, the partition board 31 and the barriers 32 form the through grooves 321.

Furthermore, the upper-row through grooves 321 are formed above the partition board 31, and the lower-row through grooves 321 are formed below the partition board 31. Each of the upper-row through grooves 321 corresponds to the bottom of the corresponding upper-row terminal slot 131. Each of the lower-row through grooves 321 corresponds to the top of the corresponding lower-row terminal slot 132. The upper-row through grooves 321 respectively communicate with the upper-row terminal slots 131. The lower-row through grooves 321 respectively communicate with the lower-row terminal slots 132. The upper-row through grooves 321 and the lower-row through grooves 321 are separated by the partition board 31. In addition, the tail portions 216 of the upper-row plug terminals 21 are respectively in the upper-row through grooves 321, and the tail portions 226 of the lower-row plug terminals 22 are respectively in the lower-row through grooves 321. The barriers 32 shield two sides of the tail portions 216 and two sides of the tail portions 226 (as shown in FIG. 4). That is, each of the through grooves 321 is defined by two adjacent barriers 32 and the partition board 31, and opposite sides of each of the tail portions 216 are shielded by the adjacent barriers 32. Similarly, opposite sides of each of the tail portions 226 are shielded by the adjacent barriers 32.

Figure 5:
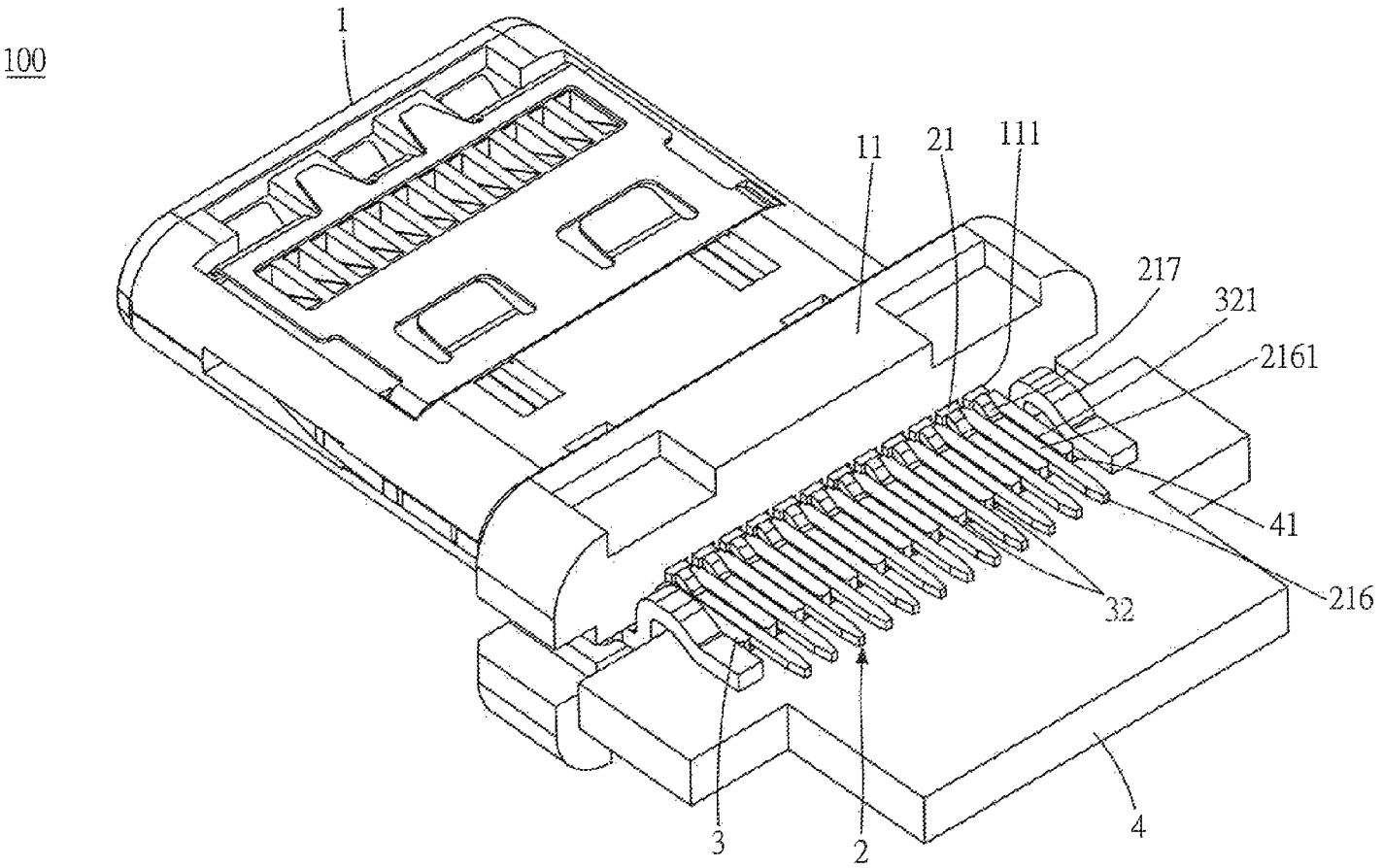
FIG. 5 is a partial perspective view of the electrical plug connector according to the instant disclosure.
Figure 6:
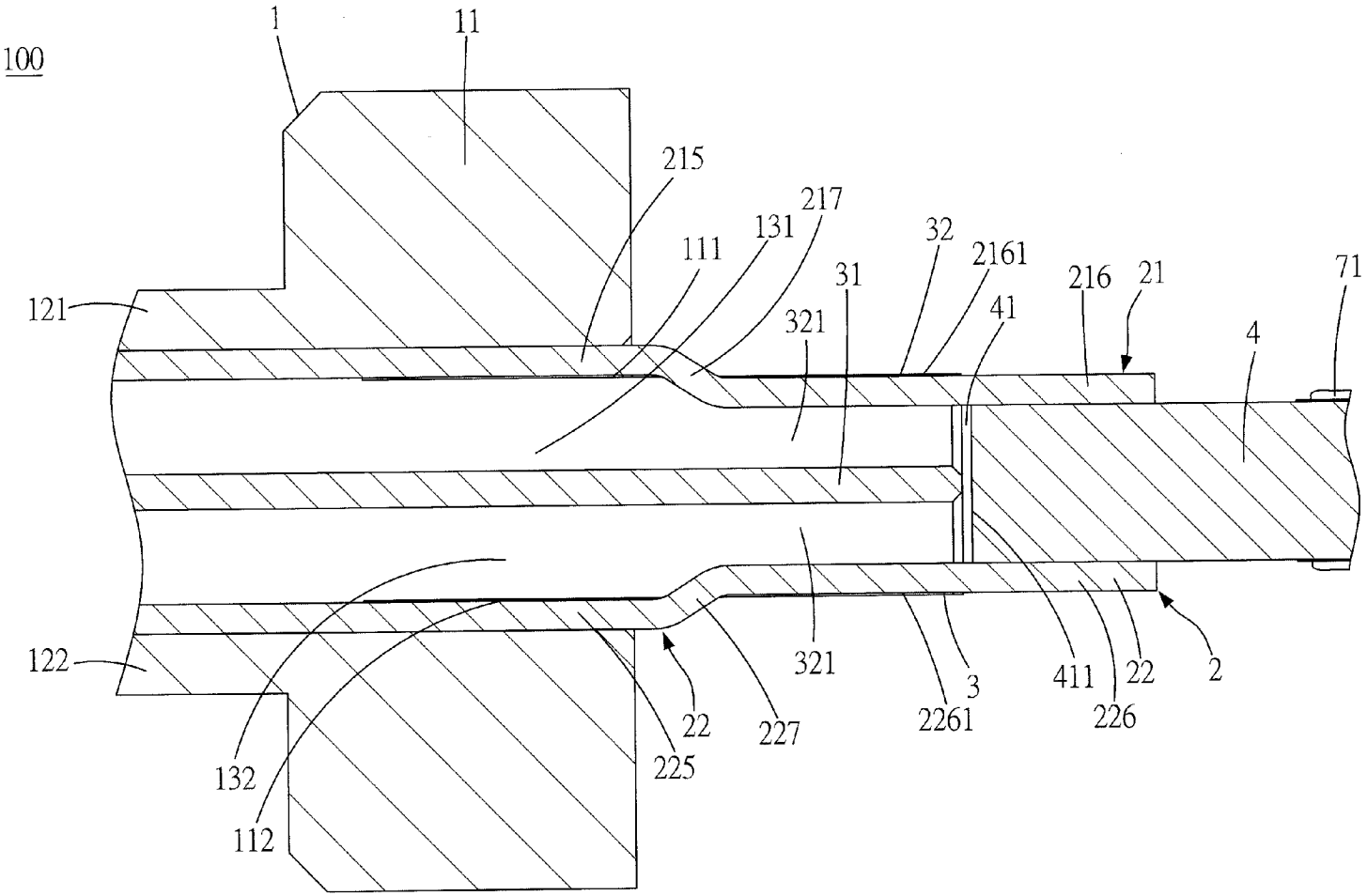
FIG. 6 is a lateral sectional view of the electrical plug connector according to the instant disclosure.
Figure 7:
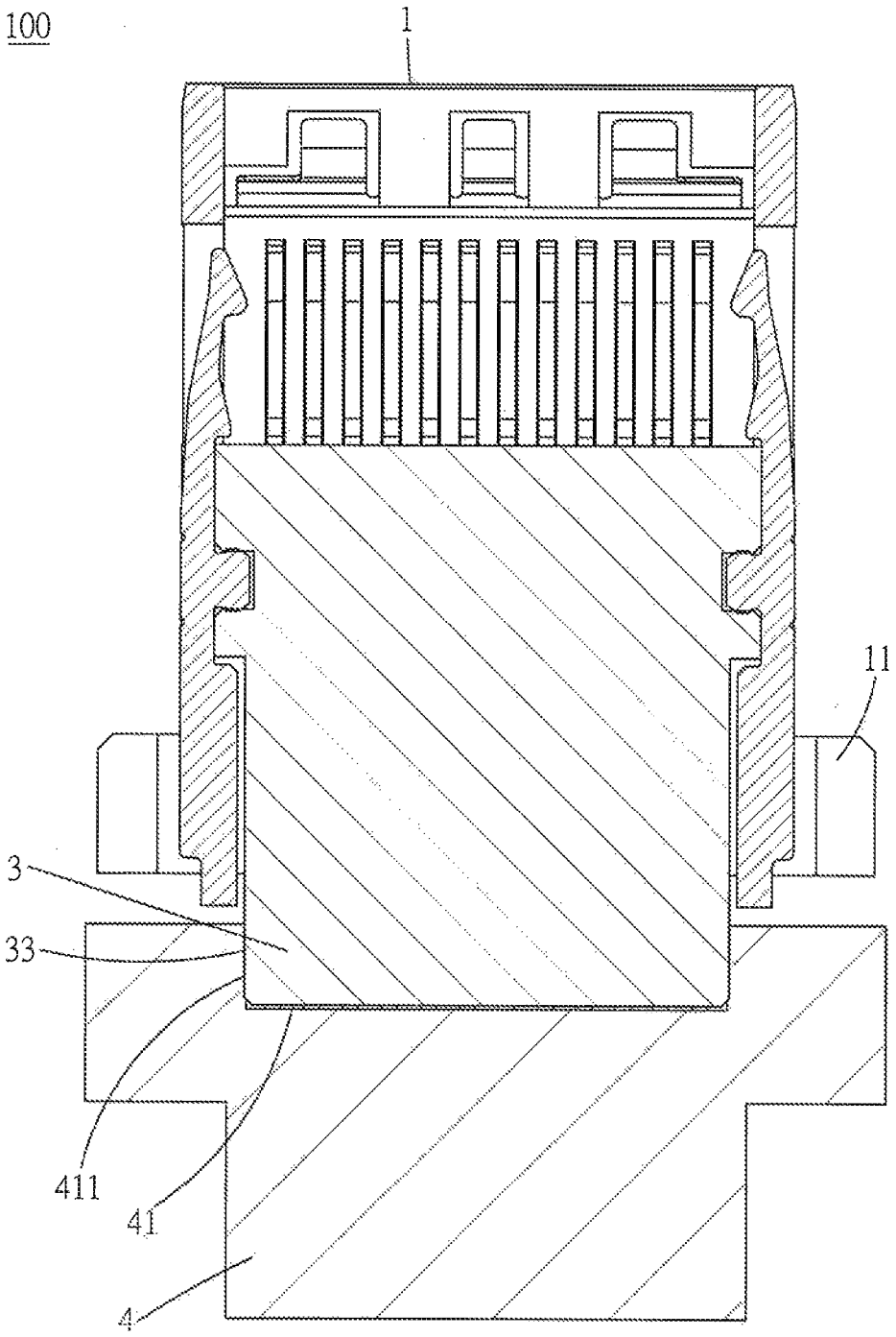
FIG. 7 is a top sectional view of the electrical plug connector according to the instant disclosure.

FIG. 5 is a partial perspective view of the electrical plug connector 100 according to the instant disclosure, FIG. 6 is a lateral sectional view of the electrical plug connector 100 according to the instant disclosure, and FIG. 7 is a top sectional view of the electrical plug connector 100 according to the instant disclosure. Referring to FIG. 4, FIG. 5, FIG. 6, and FIG. 7, when the plug terminals 2 are assembled with an insulated housing 1, the plug terminals 2 are respectively inserted into the upper-row terminal slots 131 and the lower-row terminal slots 132 from a rear side of the insulated housing 1. When the body portions 215 are respectively inserted into the upper-row terminal slots 131 and when the body portions 225 are respectively inserted into the lower-row terminal slots 132, the body portions 215 and the body portions 225 are provided to mate with each other and respectively buckled into the upper-row terminal slots 131 and the lower-row terminal slots 132. In addition, the tail portions 216 are positioned in the upper-row through grooves 321 of the fixing base 3, and the tail portions 226 are positioned in the lower-row through grooves 321 of the fixing base 3. Therefore, the barriers 32 can be limited at two sides of the tail portions 216, 226, so that the tail portions 216, 226 are positioned securely to prevent from being slanted so as not to affect subsequent soldering process.

Please refer back to FIG. 2, FIG. 3A, and FIG. 3B. In FIG. 3B, the plug terminals 2 are not installed to the insulated housing 1. In some embodiments, the base member 11 further comprises a plurality of first recessed portions 111 and a plurality of second recessed portions 112. Each of the upper-row terminal slots 131 has two first recessed portions 111 formed on opposite inner walls thereof. Each of the first recessed portions 111 is engaged with one of two sides of the corresponding upper-row terminal 21. That is, each of the first recessed portions 111 is in contact with one of the two sides of the corresponding upper-row plug terminal 21. When the body portions 215 are assembled in the upper-row terminal slots 131, one of the two sides of each of the body portions 215 is abutted against the corresponding first recessed portion 111. Moreover, in each of the upper-row terminal slots 131, the two first recessed portions 111 are defined at the upper parts of the opposite inner walls of the upper-row terminal slots 131 (as shown in 3A), and the upper-row through grooves 321 of the fixing base 3 are aligned below the upper-row terminal slots 131, respectively. Each of the lower-row terminal slots 231 has two second recessed portions 112 formed on opposite inner walls thereof. Each of the second recessed portions 112 is engaged with one of two sides of the corresponding lower-row terminal 22. That is, each of the second recessed portions 112 is in contact with one of the two sides of the corresponding lower-row plug terminal 22. When the body portions 225 are assembled in the lower-row terminal slots 132, one of the two sides of each of the body portions 225 is abutted against the corresponding second recessed portion 112. Moreover, in each of the lower-row terminal slots 132, the two second recessed portions 112 are defined at the lower parts of the opposite inner walls of the lower-row terminal slots 132 (as shown in FIG. 3A), and the lower-row through grooves 321 of the fixing base 3 are aligned above the lower-row terminal slots 132, respectively.

In addition, in this embodiment, the width between the first recessed portions 111 of each of the upper-row terminal slots 131 is greater than the width of the through grooves 321, and the width between the second recessed portions 112 of each of the lower-row terminal slots 132 is greater than the width of the through grooves 321 (as shown in FIG. 3A). Furthermore, as shown in FIG. 3A, each of the upper-row through grooves 321 and the two corresponding first recessed portions 111 form a hole having T-shaped outline, and each of the lower-row through grooves 321 and the two corresponding second recessed portions 112 form a hole having inverted-T-shaped outline. Here, the two sides of the body portion 215 of each of the upper-row plug terminals 21 are buckled to the two corresponding first recessed portions 111. Each of the upper-row plug terminals 21 further comprises a bending segment 217 extending from the body portion 215 toward the tail portion 216. That is, for each of the upper-row plug terminals 21, the body portion 215 is extending toward the tail portion 216 via the bending segment 217. Two sides of the body portion 225 of each of the lower-row plug terminals 22 are buckled to the two corresponding second recessed portions 112. Each of the body portions 225 further comprises a bending segment 227 extending from the body portion 225 toward the tail portion 226. That is, for each of the lower-row plug terminals 22, the body portion 225 is extending toward the tail portion 226 via the bending segment 227. In other words, each of the body portions 215 and the corresponding tail portions 216 are located at different horizontal lines, and each of the body portions 225 and the corresponding tail portions 226 are located at different horizontal lines. Base on this, when the two sides of the body portion 215 of each of the upper-row plug terminals 21 are buckled to the two corresponding first recessed portions 111, the bending segment 217 is bent downward and therefore changes the position of the tail portion 216, so that the tail portion 216 can be located in the corresponding upper-row through groove 321 (as shown in FIG. 4). Similarly, when the two sides of the body portion 225 of each of the lower-row plug terminals 22 are buckled to the two corresponding second recessed portions 112, the bending segment 227 is bent upward and therefore changes the position of the tail portion 226, so that the tail portion 226 can be located in of the corresponding lower-row through groove 321.

Please refer back to FIG. 2, FIG. 5, and FIG. 6. In some embodiments, each of the tail portions 216 of the upper-row plug terminals 21 further comprises an upper-row soldering top surface 2161. That is, the upper-row soldering top surfaces 2161 are defined on an upper surface of the tail portion 216. Each of the tail portions 226 of the lower-row plug terminals 22 further comprises a lower-row soldering top surface 2261. That is, the lower-row soldering top surface 2231 are defined on a lower surface of the tail portion 226. In addition, a top surface of each of the barriers 32 is higher than the upper-row soldering top surface 2161 of the tail portion 216 of the corresponding upper-row plug terminal 21, and the top surface of each of the barriers 32 is higher than the lower-row soldering top surface 2261 of the tail portion 226 of the corresponding lower-row plug terminals 22, so that the upper-row soldering top surfaces 2161 and the lower-row soldering top surfaces 2261 are respectively located in the upper-row through grooves 321 and the lower-row through grooves 321. In other words, when the tail portions 216, 226 are installed in the through grooves 321, of the tail portions 216, 226 are entirely positioned in the through grooves 321, respectively. Furthermore, the barriers 32 (as shown in FIG. 3A) are respectively protruding upward and downward from the partition board 31, such that the top surfaces of barriers 32 is higher than the upper-row soldering top surfaces 2161 and the lower-row soldering top surfaces 2261, respectively.

Figure 8:
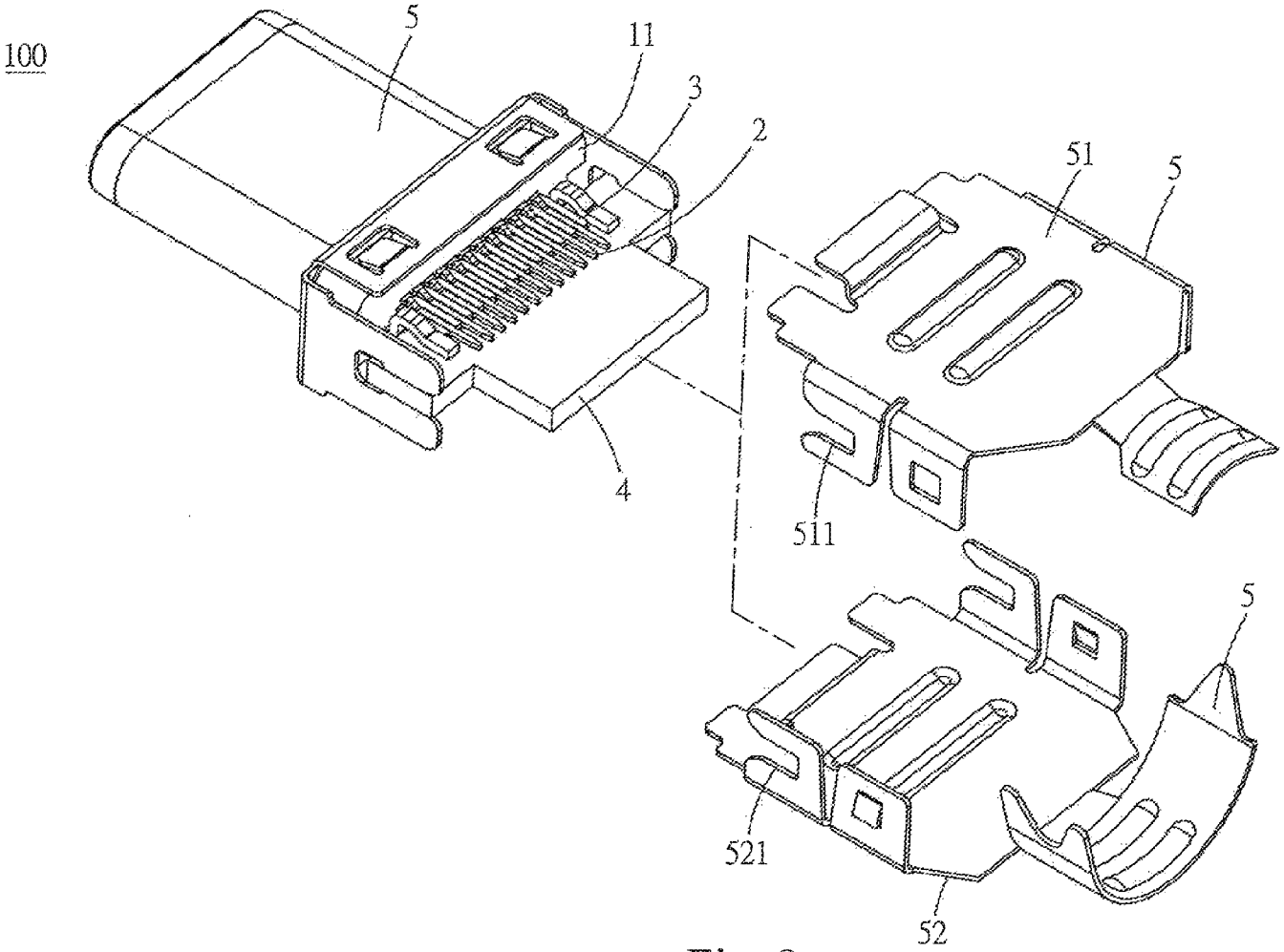
FIG. 8 is an exploded view showing that a metallic shell is assembled to the electrical plug connector according to the instant disclosure.
Figure 9:
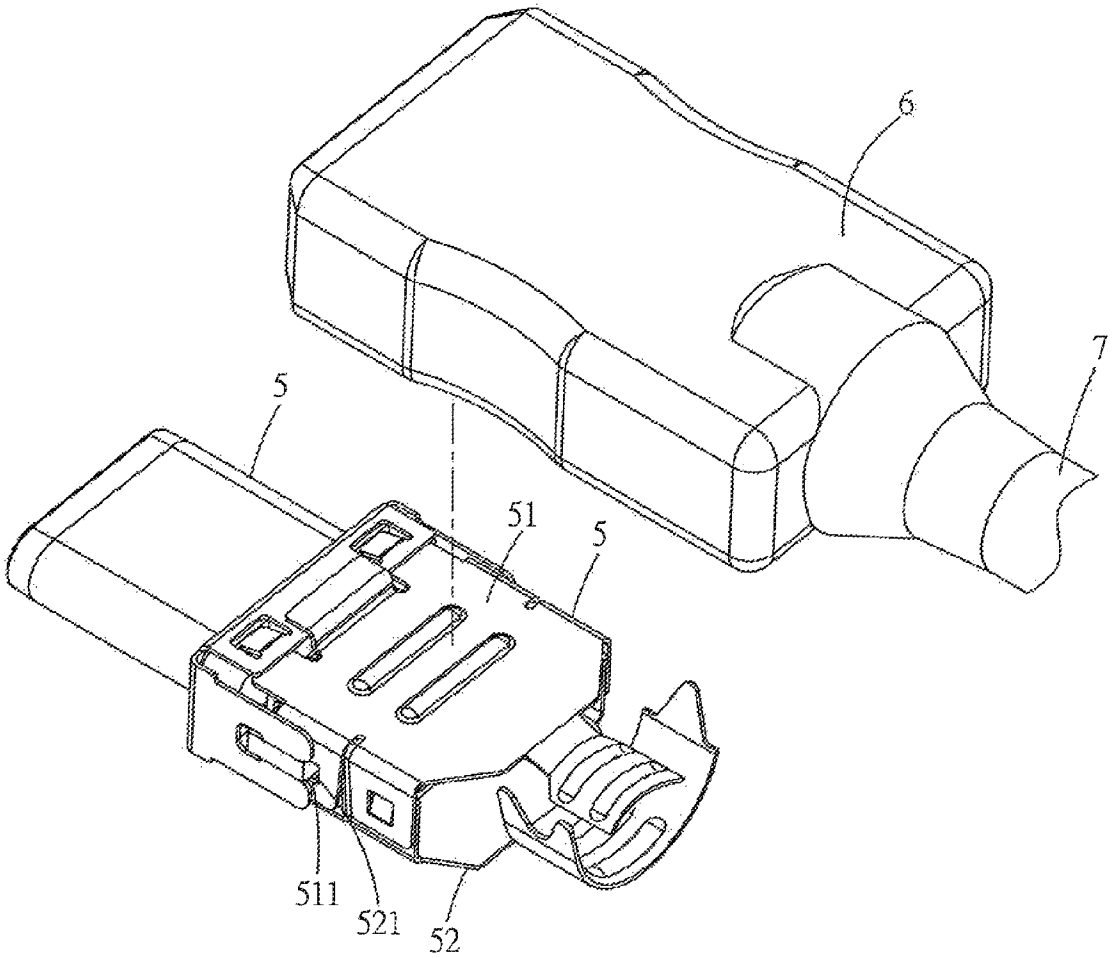
FIG. 9 is an exploded view showing that an enveloping shell and a transmission wire are assembled to the electrical plug connector according to the instant disclosure.

FIG. 8 is an exploded view showing the metallic shell 5 is to be assembled to the electrical plug connector 100 according to the instant disclosure, and FIG. 9 is an exploded view showing that an enveloping shell 6 and a transmission wire 7 are assembled to the electrical plug connector 100 according to the instant disclosure. Please refer to FIG. 2, FIG. 8, and FIG. 9. The electrical plug connector 100 further comprises a circuit board 4 and an enveloping shell 6. The circuit board 4 is assembled to the fixing base 3, and a board thickness of the circuit board 4 is less than the height of the fixing base 3. In addition, the circuit board 4 comprises a recess 41 formed at the lateral portion of the circuit board 4. After the circuit board 4 is installed to the fixing base 3, an inner wall 411 of the recess 41 of the circuit board 4 is engaged with the rear portion of the fixing base 3, and the inner wall 411 of the recess 41 shields the partition board 31 and the through grooves 321. Based on this, when proper overmolding techniques are performed over the circuit board 4, for example, during coating glues on the circuit board 4, the glues can be prevented from flowing into the front portion of the base member 11 through the through grooves 321 so as to ensure the electrical contact between the plug terminals 2 of the electrical plug connector 100 and the corresponding receptacle terminals of the electrical receptacle connector. The enveloping shell 6 and a transmission wire 7 are therefore provided to enclose the circuit board 4.

Please refer to FIG. 4, FIG. 6, and FIG. 7. Here, the tail portions 216 of the upper-row plug terminals 21 are respectively passing through and protruded from the upper-row through grooves 321, and the tail portions 226 of the lower-row plug terminals 22 are respectively passing through and protruded from the lower-row through grooves 321. The tail portions 216, 226 are respectively abutted against an upper surface and a lower surface of the circuit board 4. The circuit board 4 may further comprise a plurality of contacts defined at the upper surface and the lower surface of the circuit board 4. The tail portions 216, 226 may be soldered to the contacts, respectively, and a wire material 71 of the transmission wire 7 is soldered on the circuit board 4. Moreover, in this embodiment, the width of the fixing base 3 is less than the width of the recess 41. Therefore, after the circuit board 4 is installed to the fixing base 3, an outer lateral surface 33 of the fixing base 3 is mated with and in contact with the inner wall 411 of the recess 41. Accordingly, when the tail portions 216, 226 are soldered on the circuit board 4, the tail portions 216, 226 and the circuit board 4 are provided to enclose the fixing base 3. Thus, the distance between the circuit hoard 4 and the fixing base 3 can be reduced to prevent the glue from flowing into, for example, the through grooves 321, from the gap between the circuit board 4 and the fixing base 3 during gluing process. When proper overmolding techniques are performed over the circuit board 4, the glue are not flowing into the base member 11 from the gap between the circuit board 4 and the fixing base 3.

Please Refer to FIG. 1, FIG. 8, and FIG. 9. The electrical plug connector 100 further comprises a metallic shell 5. The metallic shell 5 is a hollow shell and defines a receiving cavity 50 therein. The insulated housing 1, the upper-row plug terminals 21, and the lower-row plug terminals 22 are received in the metallic shell 5. The metallic shell 5 encloses the plug terminals 2 to protect the plug terminals 2 and the circuit board 4. In this embodiment, the metallic shell 5 is formed by a multi-piece member, and the metallic shell 5 further comprises an upper shell 51 and a lower shell 52 combinable with the upper shell 51. The upper shell 51 and the lower shell 52 are above and below the circuit board 4, respectively. The upper shell 51 further comprises a plurality of first clamping side walls 511 clamped at two sides of the circuit board 4, and the lower shell 52 further comprises a plurality of second clamping side walls 521 partially overlapped with the first clamping side walls 511 and clamped at the two sides of the circuit board 4. When proper overmolding techniques are performed over the circuit board 4, the electrical components soldered on the circuit board 4 are protected by the metallic shell 5, so that the electrical components soldered on the circuit board 4 can be prevented from being damaged during applying glues into the metallic shell 5.

In the instant disclosure, the two sides of each of the tail portions of the upper-row plug terminals and the two sides of each of the tail portions of the lower-row plug terminals are limited by the barriers of the fixing base, thus, the tail portions of the plug terminals can be stably positioned in the through grooves, respectively. Therefore, the tail portions can be prevented from being slanting, such that the soldering process can be carried out smoothly. In addition, the width of the fixing base is less than the width of the recess. After the circuit board is assembled to the fixing base, the two outer lateral sides of the fixing base are mated with the two inner lateral surfaces of the recess. Therefore, when the tail portions are soldered on the circuit board, the tail portions and the circuit board enclose the fixing base. Moreover, the distance between the circuit board and the fixing base can be reduced, such that when overmolding is performed over the circuit board, the glue applied over the circuit board can be prevented from flowing into the gap between the circuit board and the fixing base. Furthermore, the metallic shell encloses the tail portions to protect the tail portions and the circuit board. Hence, during the gluing process, the metallic shell protects the electrical components soldered on the circuit board from being damaged. Furthermore, pin-assignments of the upper-row plug terminals and the lower-row plug terminals are 180 degree symmetrical, dual or double orientation design which enable the electrical plug connector to be inserted into an electrical receptacle connector in either of two intuitive orientations, i.e. In either upside-up or upside-down directions. In other words, the pin-assignments of the upper-row plug terminals and the lower-row plug terminals have 180 degree symmetrical, dual or double orientation design with respect to a central point of the receiving cavity as the symmetrical center. Consequently, the electrical plug connector is inserted into an electrical receptacle connector with a first orientation where the upper portion is facing up, for transmitting first signals; conversely, the electrical plug connector is inserted into the electrical receptacle connector with a second orientation where the upper portion is facing down, for transmitting second signals. Furthermore, the specification for transmitting the first signals is conformed to the specification for transmitting the second signals.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell, defining a receiving cavity therein;

an insulated housing, received in the receiving cavity, the insulated housing comprising a base member, an upper portion, a lower portion, a mating room, a plurality of upper-row terminal slots, and a plurality of lower-row terminal slots, wherein the mating room is defined between the upper portion and the lower portion, and the upper-row terminal slots and the lower-row terminal slots are defined through the base member along a longitudinal direction, wherein the upper-row terminal slots and the lower-row terminal slots communicate with the mating room, wherein the upper portion has an upper mating face, the lower portion has a lower mating face, and the upper mating face is opposite to the lower mating face;

a plurality of upper-row plug terminals held in the upper portion, wherein the upper-row plug terminals comprise a plurality of signal terminals, at least one power terminal, and at least one ground terminal, each of the upper-row plug terminals is held in the upper portion of the insulated housing and disposed at the upper mating face of the upper portion, each of the upper-row plug terminals comprises a tail portion arranged at a rear side of the base member;

a plurality of lower-row plug terminals held in the lower portion, wherein the lower-row plug terminals comprise a plurality of signal terminals, at least one power terminal, and at least one ground terminal, each of the lower-row plug terminals is held in the lower portion of the insulated housing and disposed at the lower mating face of the lower portion, each of the lower-row plug terminals comprises a tail portion arranged at the rear side of the base member; and a fixing base, extending from the rear side of the base member, wherein the fixing base comprises:

a partition board, defining two lateral surfaces corresponding to each other; and a plurality of barriers, respectively extending from the lateral surfaces, wherein a plurality of through grooves is defined between the barriers of each of the lateral surfaces, wherein the through grooves respectively correspond to the upper-row terminal slots and the lower-row terminal slots, and the through grooves communicate with the upper-row terminal slots and the lower-row terminal slots, the tail portions of the upper-row plug terminals and that of the lower-row plug terminals are respectively in the through grooves, and the barriers shield two sides of the tail portions of the upper-row plug terminals and that of the lower-row plug terminals.

2. The electrical plug connector according to claim 1, wherein the base member comprises a plurality of first recessed portions and a plurality of second recessed portions, each of the upper-row terminal slots has two first recessed portions formed on opposite inner walls thereof, each of the first recessed portions is in contact with one of two sides of the corresponding upper-row plug terminal, each of the lower-row terminal slots has two second recessed portions formed on opposite inner walls thereof, each of the second recessed portions is in contact with one of two sides of the corresponding lower-row plug terminal.

3. The electrical plug connector according to claim 2, wherein the width between the first recessed portions of each of the upper-row terminal slots is greater than the width of the through groove and the width between the second recessed portions of each of the lower-row terminal slots is greater than the width of the through groove.

4. The electrical plug connector according to claim 1, wherein each of the upper-row plug terminals comprises:

a body portion held in the insulated housing; and a flexible contact portion, extended from one of two ends of the body portion and disposed at the upper mating face of the upper portion;

wherein each of the tail portions is extended from the other end of the corresponding body portion and exposed out of the insulated housing.

5. The electrical plug connector according to claim 4, wherein each of the upper-row plug terminals comprises a bending segment, each of the bending segments is extending from the corresponding body portion toward the corresponding tail portion.

6. The electrical plug connector according to claim 1, wherein each of the lower-row plug terminals comprises:

a body portion held in the insulated housing; and a flexible contact portion, extended from one of two ends of the body portion and disposed at the lower mating face of the lower portion;

wherein each of the tail portions is extended from the other end of the corresponding body portion and exposed out of the insulated housing.

7. The electrical plug connector according to claim 6, wherein each of the lower-row plug terminals comprises a bending segment, each of the bending segments is extending from the corresponding connecting portion toward a corresponding soldering portion.

8. The electrical plug connector according to claim 1, wherein each soldering portion of the upper-row plug terminals defines an upper-row soldering top surface thereon, a top surface of each of the barriers is higher than the upper-row soldering top surface of the tail portion of the corresponding upper-row plug terminal, and the upper-row soldering top surfaces are in the through grooves, wherein each of the tail portions of the lower-row plug terminals defines a lower-row soldering top surface thereon, the top surface of each of the barriers is higher than the lower-row soldering top surface of the tail portion of the corresponding lower-row plug terminal, and the lower-row soldering top surfaces are in the through grooves.

9. The electrical plug connector according to claim 1, further comprising a circuit board assembled to the fixing base, wherein the circuit board comprises a recess, and an inner wall of the recess shields the through grooves.

10. The electrical plug connector according to claim 9, wherein each of the tail portions of the upper-row plug terminals is protruded from the corresponding through groove to abut against an upper surface of the circuit board, and each of the tail portions of the lower-row plug terminals is protruded from the corresponding through groove to abut against a lower surface of the circuit board.

11. The electrical plug connector according to claim 9, wherein the width of the fixing base is less than the width of the recess.

12. The electrical plug connector according to claim 9, wherein the metallic shell comprises an upper shell and a lower shell, the upper shell is above the circuit board and the lower shell is below the circuit board and assembled with the upper shell, the upper shell comprises a plurality of first clamping side walls for being clamped at two sides of the circuit board, and the lower shell comprises a plurality of second clamping side walls partially overlapped with the first clamping side walls and clamped at the two sides of the circuit board.

13. The electrical plug connector according to claim 1, wherein the upper-row plug terminals and the lower-row plug terminals have 180 degree symmetrical design with respect to a central point of the receiving cavity as the symmetrical center.

14. The electrical plug connector according to claim 1, wherein the upper portion and the lower portion are extended from one side of the base member.

15. The electrical plug connector according to claim 1, wherein the base member, the upper portion and the lower portion, and the receptacle are formed an unitary member by injection molding techniques for production of the insulated housing.

16. The electrical plug connector according to claim 1, wherein the base member is formed an unitary member by injection molding techniques and assembled with the upper portion and the lower portion for production of the insulated housing.

* * * * *